US005152333A

United States Patent [19]

Barbe et al.

[11] Patent Number: 5,152,333

[45] Date of Patent: Oct. 6, 1992

[54] ROLL FOR A DEVICE FOR CONTINUOUS CASTING ON A ROLL OR BETWEEN TWO ROLLS

[75] Inventors: Jacques Barbe, Saint Etienne; Alain Challaye, Sorbiers, both of France

[73] Assignee: Usinor Sacilor, Puteaux, France

[21] Appl. No.: 606,943

[22] Filed: Oct. 31, 1990

[30] Foreign Application Priority Data

Nov. 16, 1989 [FR] France ..... 89 15285

[51] Int. Cl.[5] ..... B22D 11/06

[52] U.S. Cl. ..... 164/423; 164/428; 164/429; 164/448; 29/123; 29/129

[58] Field of Search ..... 164/435, 442, 448, 441, 164/447, 423, 427, 428, 429, 443; 29/123, 125, 129, 129.5

[56] References Cited

U.S. PATENT DOCUMENTS

| | | | |
|---|---|---|---|
| 4,442,883 | 4/1984 | Yamakami et al. | 164/448 |
| 4,565,237 | 1/1986 | Draizen et al. | 164/427 |
| 4,944,342 | 7/1990 | Lauener | 164/423 |

FOREIGN PATENT DOCUMENTS

| | | | |
|---|---|---|---|
| 98968 | 1/1984 | European Pat. Off. . | |
| 260835 | 3/1988 | European Pat. Off. . | |
| 2517840 | 10/1976 | Fed. Rep. of Germany . | |
| 693973 | 11/1930 | France . | |
| 60-56458 | 4/1985 | Japan | 164/448 |
| 6487048 | 3/1989 | Japan | 164/448 |

*Primary Examiner*—Richard K. Seidel

*Attorney, Agent, or Firm*—Cushman, Darby & Cushman

[57] ABSTRACT

The roll comprises a core (6) and a sleeve (7) in which latter are provided ducts (8) for the circulation of a cooling fluid. According to the invention, the sleeve (7) is rigidly connected to the core (6) in its axially median part and substantially throughout its circumference by an assembly which prevents any axial and radial displacement in this median part of the sleeve relative to the core, such as a dovetail assembly (9, 10) or a T-way assembly. The sleeve is in contact with the core throughout its width and is maintained by its edges (7', 7'') on the core by maintaining means (11, 12, 13, 14) which allow an axial displacement but prevent a radial displacement of the edges of the sleeve relative to the core.

12 Claims, 3 Drawing Sheets

ROLL FOR A DEVICE FOR CONTINUOUS CASTING ON A ROLL OR BETWEEN TWO ROLLS

The present invention relates to the continuous casting of thin metal products such as sheets or strips, in particular of steel, on a roll or between two rolls, and more particularly relates to the construction of these rolls.

In casting installations of this type, it is known to employ rolls whose outer peripheral surface on which the cast metal is made to solidify or freeze is cooled by circulation of a cooling fluid inside the roll. Usually, these rolls comprise a central part or "core" surrounded by a sleeve composed of a heat conductive material, such as copper. The cooling fluid circulates in ducts provided at the interface between the core and the sleeve or in the sleeve itself.

A known problem in the use of these rolls results from the deformation of the sleeve due to its heating by contact with the molten metal. As the metal of the sleeve heats up, the sleeve tends to expand radially and axially. The radial expansion tends to increase the diameter of the roll which results, in the case of casting between rolls, in a reduction in the spacing between the rolls and therefore in a reduction in the thickness of the cast product. Moreover, as this radial expansion is not necessarily uniform throughout the width of the roll, variations in thickness may occur along the width of the product.

The axial expansion tends to increase the width of the sleeve in the axial direction of the roll. But this axial expansion essentially occurs in the region of the outer surface of the sleeve, while, owing to the internal cooling, there is practically no expansion in the region of the cooling ducts. Consequently, a differential expansion occurs which results in a camber of the outer surface of the sleeve, the diameter of the latter being larger in its axially median part than toward the ends, i.e. at the edges of the sleeve. This camber of the rolls is a redhibitory defect since it results in the production of a cast product which is thinner in its median zone than at its edges, which is unacceptable for the subsequent rolling of the product.

In order to compensate for this camber in the hot state, it has already been proposed to give a concave shape to the external surface of the sleeve in the cold state. In this way it is possible to obtain a product whose surfaces are planar, or even preferably very slightly cambered, which is desirable for the subsequent rolling.

However, such an arrangement may be insufficient above all in the case of rolls of large width. Indeed in this case it will be necessary to have in the cold state a large concavity of the outer surface of the sleeve, which, at the beginning of the casting, would result in an excessive space between the rolls in the axially median zone.

In an attempt to solve this problem, it has already been proposed in document EP 98968 to maintain the sleeve rigidly on the core solely in the axially median zone and to leave the edges of the sleeve free and unconnected to the core of the roll and maintained radially spaced from the latter so as to avoid preventing the expansion of the sleeve in the axial direction, which expansion would inevitably result in a camber if the edges of the sleeve were rigidly connected to the core which does not itself expand.

This arrangement therefore permits limiting the increase in the diameter of the sleeve in its axially median zone by arresting its radial expansion. However, it does not eliminate the possibility of a deformation in the form of a camber due to the differential axial expansion between the outer surface of the sleeve and the zone of the cooling ducts, since, as a result of this differential expansion, the edges of the sleeve may approach the core.

Further, such an arrangement is unsuitable in the case of casting between rolls where the forces exerted radially on the sleeve by the cast product (rolling forces) are very high in the vicinity of the walls closing the casting space, and therefore precisely on the edges of the sleeve. Indeed, owing to the fact that the sleeve is not supported on its edges by the core, said forces may greatly deform the edges of the sleeve and accentuate its camber.

An object of the present invention is to provide a roll for casting thin metal products whereby it is possible to obtain a cast product having satisfactory dimensional characteristics for the subsequent rolling of this product. It has more specifically for object to solve the various problems mentioned hereinbefore.

For these purposes, the invention provides a roll for a device for the continuous casting of thin products on a roll or between two rolls, said roll comprising a core and a sleeve in which latter ducts are provided for the circulation of a cooling fluid.

According to the invention, said roll is characterized in that the sleeve is rigidly connected to the core in its axially median part and substantially throughout its circumference, by an assembly preventing any radial and axial displacement in said median part of the sleeve relative to the core, and the sleeve is in contact with the core throughout its width and is maintained on the core by its edges by radial maintaining means allowing an axial displacement but preventing a radial displacement of said edges of the sleeve relative to the core.

In a preferred arrangement, the assembly connecting the sleeve to the core in its axially median part is a dovetail assembly or a T-way assembly.

According to a particular arrangement of the invention, the sleeve is also maintained in axially intermediate zones between its axial median part and its edges by maintaining means allowing an axial displacement but preventing a radial displacement of said intermediate zones of the sleeve relative to the core.

Owing to the invention, the sleeve is consequently firmly maintained on the core at least in its axially median part and on its edges; any radial displacement of the sleeve owing to expansion is therefore prevented, but the displacements in the axial direction of the lateral zones of the sleeve are allowed, which avoids the cambering of the wall which would result from a buckling brought about by a clamping of the edges of the sleeve which prevents its axial expansion.

According to another particular arrangement, said means for maintaining the edges are formed by cheeks including a circular groove of rectangular cross-section into which axially extends a corresponding rib on the edges of the sleeve, with an axial clearance and no radial clearance.

In a further arrangement, more particularly advantageous, the core comprises a circumferential groove having a dovetail cross-section in which is clamped a rib having a corresponding dovetail cross-section on the inner surface of the sleeve, the core being for this purpose composed of a central part or hub, the periphery of which defines one side of said dovetail groove, and an annular clamp member which is fitted on the core and has a periphery which defines the other side of said groove, the hub and the annular clamp member being held assembled by clamping means acting in the axial direction for clamping the rib of the sleeve in the groove of the core.

In a complementary arrangement, said annular clamp member also defines a circular groove of rectangular cross-section into which extends the corresponding rib of one of the edges of the sleeve for ensuring the maintenance thereof, a cheek ensuring in the same way the maintenance of the other edge of the sleeve.

This arrangement has in particular the advantage, as will be more easily understood hereinafter, of permitting the use of sleeves of different widths while conserving the same hub and changing only the sleeve, the cheek and the annular clamp member mentioned hereinbefore.

Further features and advantages will be apparent from the following description which is given by way of example of a roll according to the invention for a installation for the continuous casting between rolls of thin steel products such as strips having a thickness of a few millimeters and a width of several tens of centimeters.

With reference to the accompanying drawings.

Figure 1:
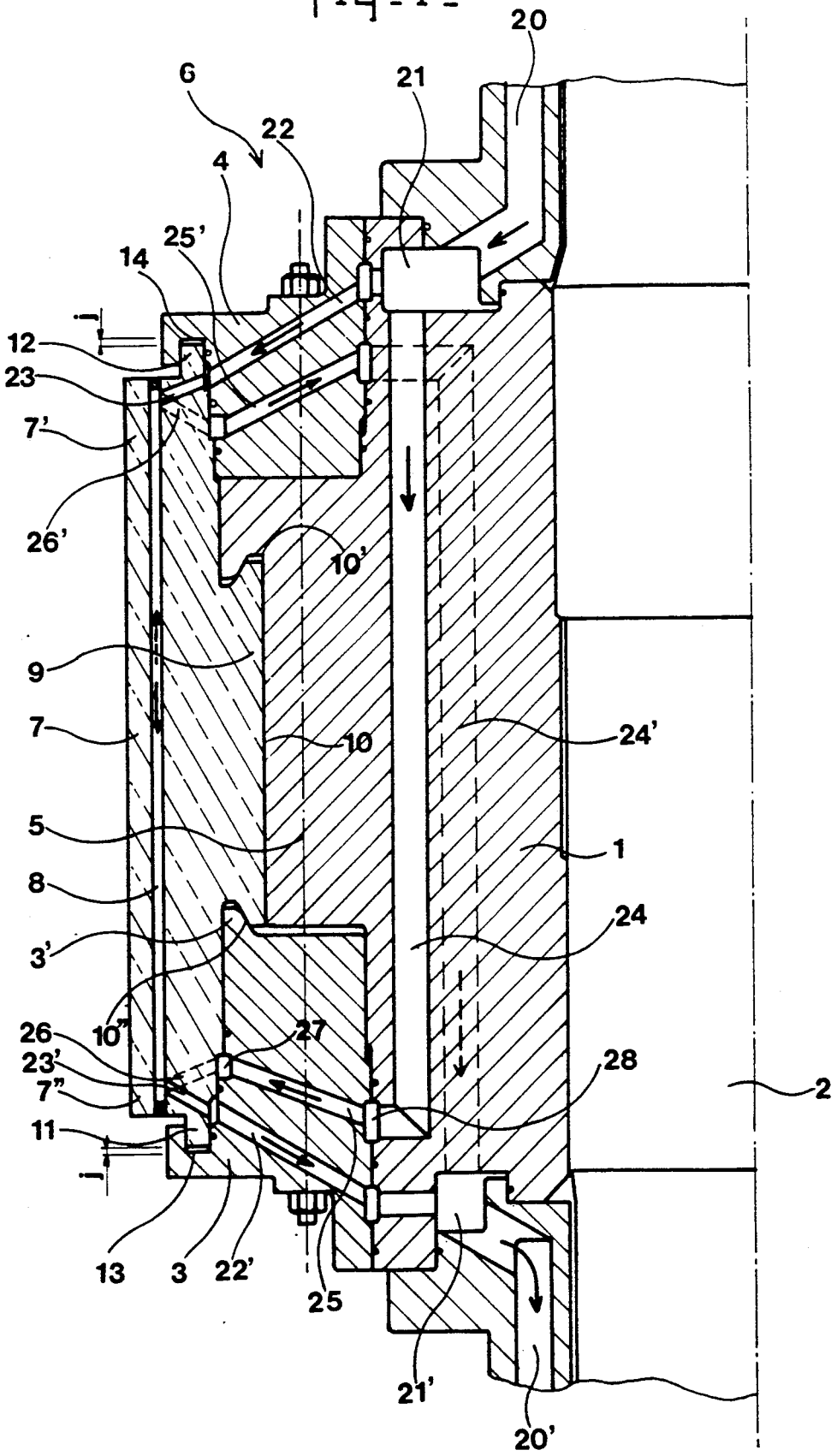
FIG. 1 is a semi-axial sectional view of a roll according to the invention.

The roll shown in section in FIG. 1 comprises a hub 1 rigidly mounted, for example by a shrink fit, on a shaft 2 for driving the shaft in rotation. The ends of the shaft 2 are arranged to journal in bearings of the casting installation and one of these ends is connected to means (not shown) for driving the shaft in rotation.

The hub 1 carries on one side an annular clamp member 3 and on the other side a cheek 4, these three coaxial parts, held assembled by tie rods 5 which are represented in the Figures solely by their axes, constituting the core 6 of the roll.

A sleeve 7 composed of a heat conductive material such as copper surrounds the core of the roll, it being fitted on the hub 1, the clamp member 3 and the cheek 4.

Internally and in its axially median zone, the sleeve defines a circumferential rib having a dovetail cross-section. This rib 9 is engaged in a groove 10 of corresponding cross-section whose side 10' (the right side as viewed in FIG. 1) is machined in the hub 1 and whose other side 10'' is formed by a projection 3' on the annular clamp member 3. In other words, it is the unit formed by the assembly of the hub 1 and the annular clamp member 3 and constituting the core 6 of the roll which defines the groove 10.

As will be easily understood, this arrangement consisting in forming the groove 10 by assembly of two parts constituting the core is required to permit placing the sleeve in position. The fact that the cross-section of the rib 9 of the sleeve and of the corresponding groove is a dovetail has in addition the advantage of very effectively holding the sleeve against the core by a simple clamping together of the different parts of the core. Further, the conical bearing surfaces formed by the oblique surfaces of the circular dovetail groove result in an energetic clamping of the sleeve on the core which permits the transmission of high torque with no risk of slip between the sleeve and the hub. This clamping effect is still further accentuated upon the heating of the sleeve owing to the cambering of the sleeve which tends to occur and which still further increases the contact pressure between the conical surfaces of the assembly.

The sleeve is also maintained by its edges by means of circular grooves 13, 14 of rectangular cross-section formed respectively in the annular clamp member 3 and the cheek 4 and in which are engaged with no radial clearance ribs 11, 12 axially extending the sleeve. An axial clearance "j" in the cold state is provided between respectively said grooves 13, 14 and the ribs 11, 12 to allow the axial displacement of the ribs in the grooves which may occur upon axial expansion of the sleeve when the latter heats up. Further, the maintenance of the edges of the sleeve by this system of ribs and grooves prevents the edges of the sleeve from possibly coming away from the core of the roll, which could result from the radial expansion of said edges.

In order to ensure a cooling of the sleeve which is as homogeneous as possible, the cooling water is made to circulate in the direction of the arrows shown in FIG. 1 in opposite directions in adjacent ducts 8. To this end, the roll comprises water inlet ducts 20 connected to a rotating joint (not shown). These ducts 20 communicate with a circular distribution passage 21. The water reaching this passage is directed on one hand to one end 7' of the sleeve through bores 22 in the cheek 4 and bores 23 formed in the sleeve and communicating with one half of the total number of cooling ducts 8 feeding cooling water to alternately every other one of these ducts. Further, the water from the distribution passage 21 is conducted toward the other end 7'' of the sleeve through axial ducts 24 provided in the hub and bores 25 and 26 respectively provided in the annular clamp member 3 and the sleeve in a similar way to the bores 22 and 23, the bores 26 in the sleeve feeding water to the other half of the cooling ducts.

The cooling water is discharged in an equivalent manner through the bores 23', 22' and 26', 25', ducts 24', a manifold 21', and outlet ducts 20'.

In order to ensure a homogeneous distribution of the water flows, the different ducts and bores are radially evenly spaced apart and circular grooves such as 27, 28 with which communicate the different bores, such as 25, may be provided in the region of the different contact surfaces of the different parts making up the core.

Said grooves moreover permit avoiding a precise circumferential positioning upon assembly of the different parts making up the roll and in particular of the sleeve on the core.

For the same purpose of ensuring a homogeneous distribution of the water flows in the different cooling ducts, means are preferably provided for adjusting the pressure drop in the direct circulation circuit of the water (from the right toward the left, as viewed in FIG. 1, in the ducts 8) comprising the bores 22, 23, 23', 22'. Indeed, this circuit is shorter than the circuit causing the water to circulate in the cooling ducts in the opposite direction (from the left toward the right) and consequently the pressure drops are lower therein. Said means therefore permit equalizing the pressure drop in said two circuits. They may consist for example in reducing the minimum cross-section of passage in the shorter circuit, either by providing the bores 22, 22' with a smaller diameter than the bores 25, 25', or by inserting in said circuit members provided with calibrated orifices or the like.

It will be understood that both edges of the sleeve may be maintained by cheeks such as 4, the annular clamp member then having for function to support the sleeve and clamp the latter by the dovetail assembly, the cheek located adjacent to said clamp member solely serving to maintain the corresponding edge of the sleeve. In other words, the annular clamp member 3 is in this case replaced by two parts one of which is cheek identical to the cheek 4 located on the other side of the sleeve, the different component parts of the core being assembled by tie rods 5 as mentioned hereinbefore.

Clamp members such as the clamp member 3 could of course also be employed on both sides of the sleeve; in other words, the sleeve is then in direct contact with the hub 1 solely in its median part by the surface constituting the bottom of the groove 10, and in contact with the clamp members 3 of each side.

Preferably, the width of the dovetail groove is about at least one half of the width of the sleeve. It has indeed been found that the width of the groove determines the deformation of the outer surface of the sleeve in the course of casting. For example, for a sleeve 865 mm wide whose outer surface is in the cold state cylindrical with a rectilinear generatrix, the maximum variation in the hot state in the outside diameter of the sleeve along the width of the latter is 0.12 to 0.25 mm if the width of the groove is about 300 mm, 0.11 to 0.17 mm if this width is about 350 mm, and 0.05 to 0.14 mm if the width is about 430 mm, namely one half of the width of the sleeve.

In the last mentioned case, the generatrix of the sleeve has a slight camber in the middle and in the axially intermediate zones between the sides of the dovetail groove and the edges of the sleeve, i.e. in the regions where it is not maintained on the core. These deformations in the hot state may of course be compensated for by an additional machining carried out in the cold state so as to obtain a rectilinear generatrix or a very slightly concave generatrix in the operating conditions established when casting. These deformations are distinctly less than that of the order of 1 mm which may be found in sleeve-core connection systems of the prior art.

Figure 3:
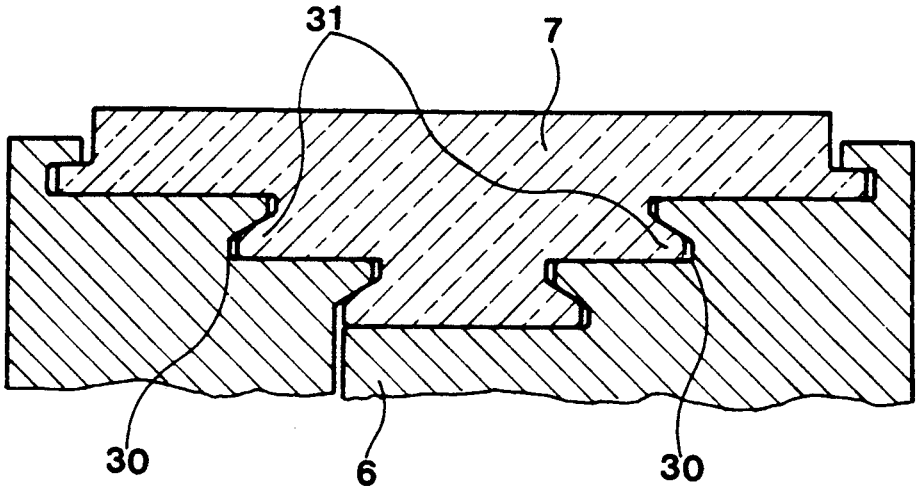
FIG. 3 is a simplified partial axial sectional view of a variant of the invention.

In order to still further limit this deformation, the assembly may be arranged in accordance with the simplified representation of FIG. 3. In this case, the sleeve 7 is maintained on the core 6 in its axially median part and on its edges, as in the preceding embodiment. Further, it is also maintained in axially intermediate zones between the median part and the edges by grooves 30 and corresponding ribs 31 similar to the edge-maintaining grooves and ribs, preventing the radial displacement, and therefore the camber, of the sleeve in the region of these groove and ribs but allowing an axial relative displacement, an axial clearance being provided in the cold state for this purpose between the grooves and ribs.

Figure 2:
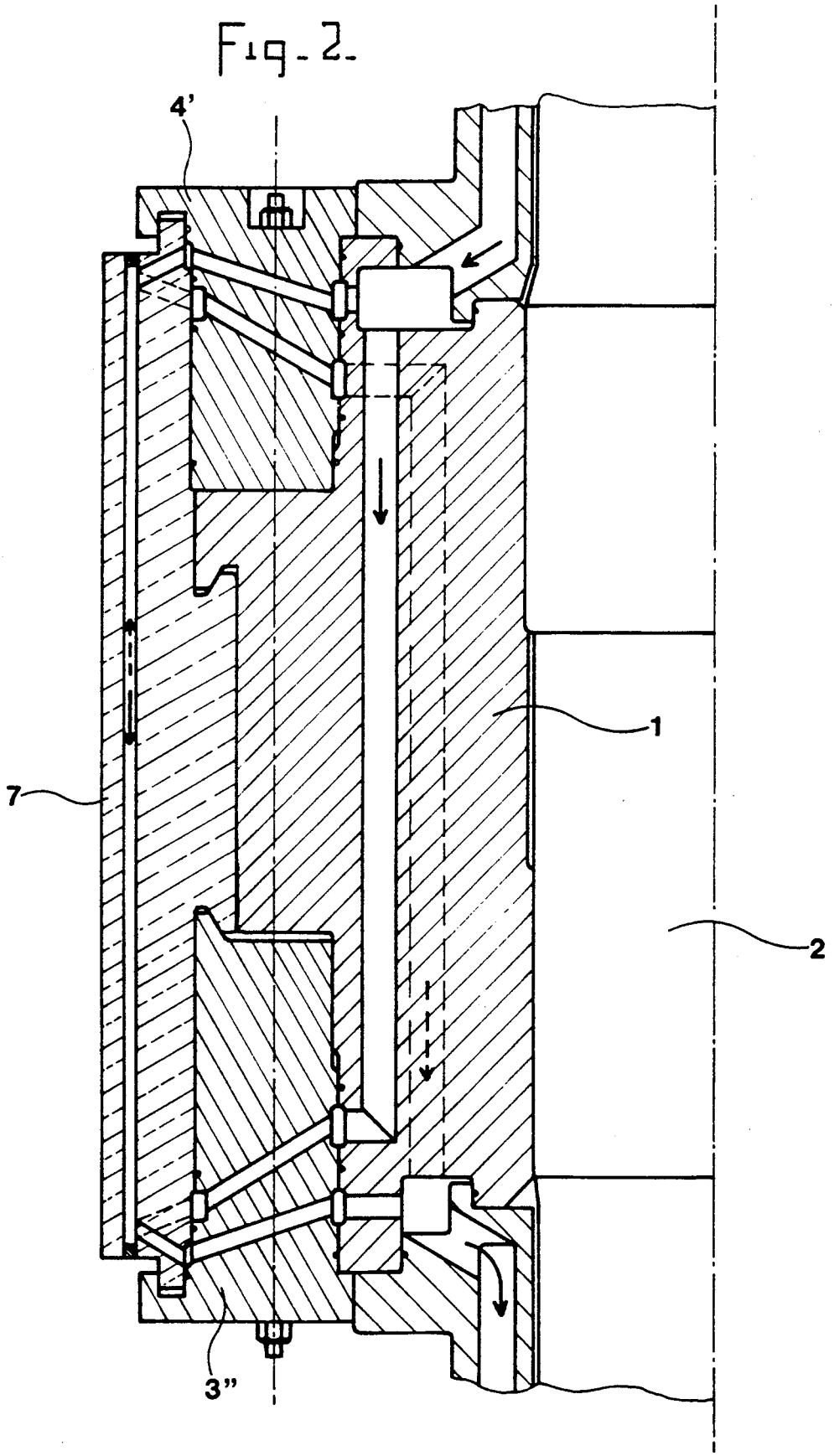
FIG. 2 is a semi-axial sectional view of a roll adapted to cast products of greater width.

Another advantage of the configuration of the assembly of the different parts of the roll previously described with reference to FIG. 1, will appear from FIG. 2 which represents a roll having a sleeve of greater width. This roll is constructed in a manner similar to the roll previously described and in particular the hub 1 and the dovetail assembly are identical.

Only the width of the sleeve 7 is different, as are the annular clamp member 3'' and the cheek 4' which are adapted to the new width of the sleeve.

It will be easily understood that the casting of products of different widths will therefore only require the replacement of these three parts (sleeve, clamp member and cheek), the hub 1 remaining the same irrespective of the width of the sleeve.

Figure 4:
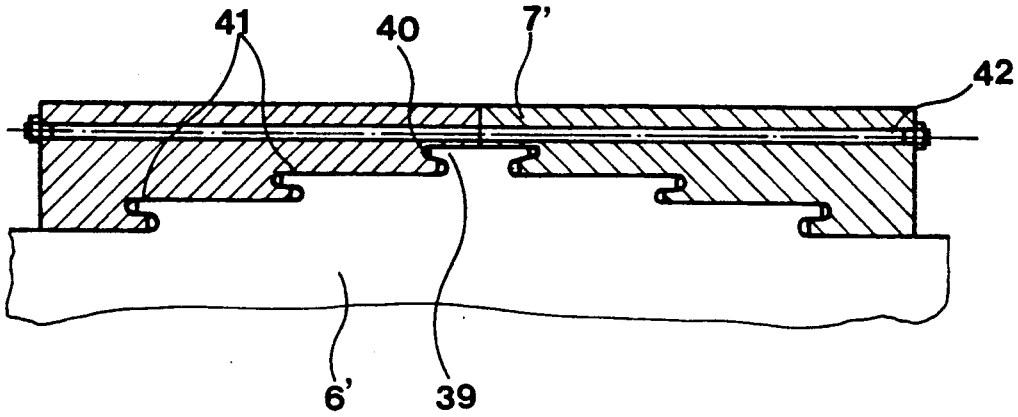
FIG. 4 is a view of another variant in which the sleevecore assembly is achieved by means of stepped grooves facing in the opposite direction to the preceding embodiments.

FIG. 4 is a diagrammatic view of another variant of the invention. In this case, the dovetail assembly is reversed, i.e. it is the core which includes in its axially median part a rib 39 clamped in a corresponding groove 40 in the sleeve. Likewise, the maintenance of the sleeve on its edges, and possibly in the intermediate zones, is ensured by groove-rib systems 41 which prevent the radial deformation of the sleeve 7' while allowing its axial displacement relative to the core 6' of the roll. To permit placing the sleeve in position, the sleeve may be made in two parts which are symmetrical relative to the axially median plane and assembled by tie rods 42. The core itself may be in two parts, with the separation in the region of said median plane, means being provided for moving these two parts away from each other and thereby ensuring the clamping of the dovetail assembly.

Whatever embodiment is employed, the outer surface of the sleeve may be machined in the cold state with a profile which takes into account the deformations which may occur in the hot state so as to provide, in established operating conditions of the casting, a perfectly cylindrical surface or a slightly concave surface producing a cast product whose surfaces are planar or have a slight camber desirable for a subsequent rolling.

What is claimed is:

1. Roll for a device for the continuous casting of thin metal products on a roll or between two rolls, said roll comprising an axis of rotation, a core, a sleeve coaxially mounted on said core and having lateral edge portions, ducts in said sleeve for a circulation of a cooling fluid, and an assembly means associated with said sleeve and said core for rigidly connecting said sleeve to said core in an axially median part of said sleeve and on substantially the whole of the circumference of said sleeve for preventing any axial and radial displacement in said median part of said sleeve relative to said core, said sleeve being in contact with said core throughout the width of said sleeve, and radial edge portion-maintaining means for maintaining said edge portions of said sleeve on said core and allowing an axial displacement of said edge portions of said sleeve but preventing a radial displacement of said edge portions of said sleeve relative to said core.

2. Roll according to claim 1, comprising second radial maintaining means associated with said sleeve and said core for maintaining said sleeve in axially intermediate zones of said sleeve between said axially median part and said edge portions, said second radial maintaining means allowing an axial displacement of said intermediate zones but preventing a radial displacement of said intermediate zones of said sleeve relative to said core.

3. Roll according to claim 1, wherein said radial edge portion-maintaining means comprise cheek members each defining a circular groove of rectangular cross-section, and a rib on each of said edge portions of said sleeve which corresponds to the respective groove of said grooves and axially extends into said respective groove with an axial clearance but no radial clearance.

4. Roll according to claim 1, wherein said assembly means for connecting said sleeve to said core in said median part is an assembly selected from a group consisting of a dovetail assembly and a T-way assembly.

5. Roll according to claim 4, wherein said dovetail assembly comprises a groove of dovetail cross-section and a rib of corresponding dovetail cross-section, and said groove has a width which is at least about one half of the width of said sleeve.

6. Roll according to claim 4, wherein said dovetail assembly for connecting said sleeve to said core in said median part comprises a groove in said sleeve and a rib on said core which is of corresponding section to said groove, and means for clamping said rib in said groove.

7. Roll according to claim 4, wherein said dovetail assembly comprises a circumferential groove of dovetail cross-section in said core, and a rib of dovetail cross-section corresponding to said dovetail cross-section of said groove and provided on an inner surface of said sleeve, said roll further comprising clamping means operative axially of said roll for clamping said rib of dovetail cross-section in said groove of dovetail cross-section, said core comprising a central part defining a hub having a peripheral portion which defines a first side of said groove of dovetail cross-section, and an annular clamp member fitted on said hub and having a peripheral portion which defines an opposite second side of said grove of dovetail cross-section.

8. Roll according to claim 5, wherein said groove of dovetail cross-section has a width which is at least about one half of the width of said sleeve.

9. Roll according to claim 7, wherein said annular clamp member further defines a circular groove of rectangular cross-section and a rib on a first edge portion of said edge portions of said sleeve corresponds to said circular groove of said annular clamp member and extends into said circular groove of said annular clamp member so as to retain said first edge portion of said sleeve on the core, said roll further comprising a cheek member cooperative with a second edge portion of said edge portions of said sleeve and defining a circular groove of rectangular cross-section, and a rib on said second edge portion of said sleeve which corresponds to said circular groove of said cheek member and extends into said circular groove of said cheek member so as to retain said second edge portion of said sleeve on the core.

10. Roll according to claim 6, wherein said groove of dovetail cross-section has a width which is at least about one half of the width of said sleeve.

11. Roll according to claim 1, wherein said cooling ducts extend in a direction parallel to said axis of said roll, said roll further comprising means defining a cooling fluid inlet and means defining a cooling fluid outlet, ends of said ducts which are located adjacent to the same edge portion of said sleeve being alternately connected to said inlet and said outlet so as to ensure a circulation of said fluid in opposite directions in two adjacent ducts of said ducts.

12. Roll according to claim 1, wherein said sleeve has an outer surface of concave shape in a cold state of said roll.

* * * * *